United States Patent [19]

Lee et al.

[11] 3,976,421

[45] Aug. 24, 1976

[54] APPARATUS FOR SEDIMENT CONTROL IN OIL BURNER INSTALLATIONS

[76] Inventors: Eugene T. Lee, 11 Mountainview Ave.; Leonard J. Box, 1363 Pleasant Valley Way, both of West Orange, N.J. 07052

[22] Filed: Dec. 30, 1974

[21] Appl. No.: 537,436

[52] U.S. Cl. ..... 431/29; 431/86; 137/624.11; 141/18

[51] Int. Cl.[2] ..... F23N 1/00

[58] Field of Search ..... 431/2, 13, 29, 86; 137/624.11; 141/2, 18; 210/138

[56] References Cited

UNITED STATES PATENTS

| | | | |
|---|---|---|---|
| 2,054,041 | 9/1936 | Persons | 431/86 |
| 3,366,551 | 1/1968 | Kaso | 210/138 |
| 3,867,290 | 2/1975 | Mackey | 210/138 |

*Primary Examiner*—Carroll B. Dority, Jr.
*Attorney, Agent, or Firm*—Carella, Bain, Gilfillan & Rhodes

[57] ABSTRACT

This invention relates to oil burner installations which include a storage tank for the oil and a pump for delivering oil from the storage tank to a burner. When the storage tank is refilled with oil, sediment at the bottom of the tank is stirred up and placed in suspension. If the pump is operated while such sediment remains in suspension, the sediment may be drawn into the fuel line. Upon reaching the burner, such sediment may disable the oil burner installation by clogging the burner orifices.

By preventing the oil pump from operating for a predetermined period of time after commencing to transfer oil into the oil storage tank, sediment is allowed to settle once again to the bottom of the tank. After the predetermined interval of time has elapsed, the pump and burner are once again permitted to operate, and the system then draws sediment-free oil into the fuel line and thence to the burner.

6 Claims, 2 Drawing Figures

BASIC CONTROL CIRCUIT

CONTROL CIRCUIT INCORPORATING SEDIMENT CONTROL TIMER

APPARATUS FOR SEDIMENT CONTROL IN OIL BURNER INSTALLATIONS

BACKGROUND OF THE INVENTION

This invention relates to oil burner installations generally, and in particular to a method and apparatus for insuring that the oil supplied from a storage tank to a burner in such an installation is sediment-free, in order to preclude clogging of the burner orifices.

When the oil storage tank of such a system is refilled, the incoming oil agitates the oil within the tank so that sediment at the bottom of the tank is stirred up and placed in suspension. If the oil pump in such a system is operated while the storage tank is being refilled, or too soon after the storage tank has been refilled, suspended sediment may be drawn into the fuel line to the burner. Upon reaching the burner, this sediment may cause clogging of the burner orifices with resultant malfunction of the system.

Prior art known to the Applicant includes the use of time delays in oil and gas burner installations for control and safety functions. Examples include automatic lighting and extinction, and the provision of delayed switching action, in gas burners. Also known to the prior art relating to oil burner installations is the use of a time delay switch to cut off the fuel for a predetermined interval to prevent accumulation of fuel in the furnace in the event of failure of an automatic flame detector. The use of solid-state timing elements in these and similar applications is also known.

SUMMARY OF THE INVENTION

The primary object of the present invention is to provide apparatus for reducing the incidence of clogged burner orifices resulting from sediment, having been stirred up from the bottom of the oil storage tank by the addition of oil to the tank, being drawn into the fuel line to the burner. This object is accomplished by detecting when the oil storage tank is about to be refilled and preventing the oil pump from operating, and hence from drawing oil and sediment into the fuel line, for a predetermined time interval commencing immediately prior to refilling of the oil storage tank. During this interval, the sediment once again settles to the bottom of the oil storage tank, so when the oil pump resumes operation only sediment-free oil is drawn into the fuel line to the burner.

A further object of the invention is to provide apparatus for counting the number of times it is detected that the oil storage tank is about to be refilled, and for indicating such count. This feature can serve as a check on system operation, and it furnishes as well a record of the number of times the oil storage tank has been refilled. It is most important in those embodiments of the invention which call for a voluntary act, such as actuating a key-operated switch, on the part of the individual filling the tank. In these embodiments, the count serves as a check that the individual filling the tank actually acknowledged the operation by, for example, actuating the key-operated switch.

DESCRIPTION OF THE INVENTION

An oil burner installation typically includes an oil storage tank, for receiving and storing oil; an oil burner, for burning oil; an oil pump for pumping oil from the storage tank to the burner; an electric motor, for operating the pump; an ignition transformer, for igniting the oil at the burner; a fuel line connecting the storage tank to the pump to the burner; and a control circuit, including a thermostat, for coordinating the operation of the various controllable elements of the system.

While the description that follows refers to elements such as relays, coils, contacts, switches, etc., it will be understood by those skilled in the art that equivalent elements, such as solid-state devices, are equally applicable. The terms "coil" and "contact" include the equivalent elements of solid-state switching devices.

Figure 1:
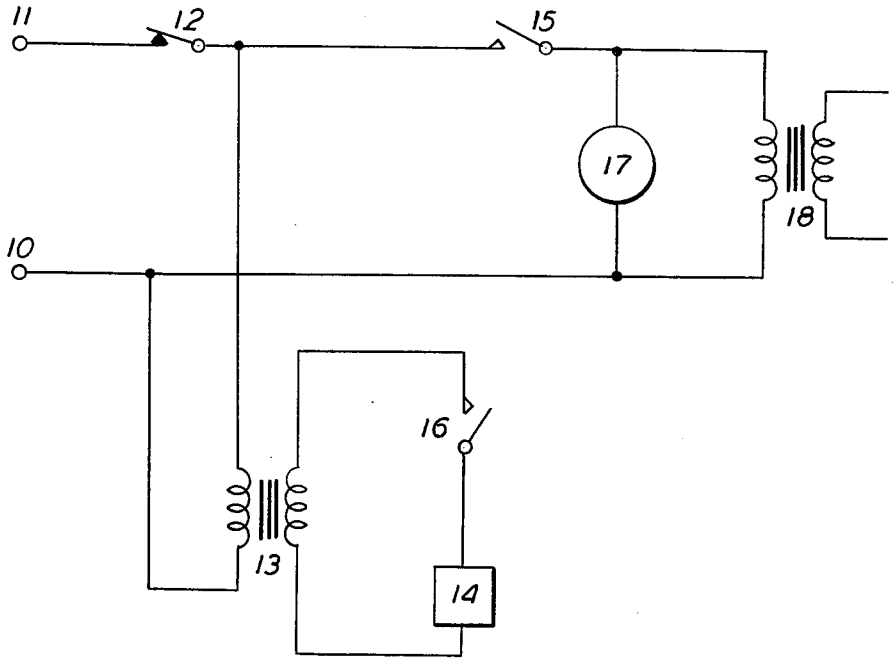
FIG. 1 is a schematic drawing of an illustrative basic control circuit for an oil burner installation.

FIG. 1 shows a representative basic control circuit for an oil burner installation prior to incorporation of the sediment control apparatus of the present invention. Power-line voltage, for example 117 Vac 60 Hz, is applied across a pair of terminals: a "hot" terminal 11 and a in series with terminal 10. Limit control switch contacts 12 are connected with the hot terminal 11 and the remaining circuitry. A control transformer 13 serves to reduce the power-line voltage to a lower voltage for operation of controls. A control relay, including a control relay coil 14 and control relay contacts 15 are also provided. Control relay coil 14 is connected, via thermostat contacts 16, across the low voltage secondary winding of control transformer 13. It will be recognized by those skilled in the art that various other control circuits are also used, frequently involving additional contacts in series with the control relay coil 14.

Control relay contacts 15 are connected in the hot line so as to control application of electric power to the electric motor 17 and the primary winding of an ignition transformer 18. Therefore, in the basic control circuit illustrated, when thermostat contacts 16 close, the coil 14 of the control relay is energized, thereby causing control relay contacts 15 to close and apply electrical power to both the electric motor 17 and the primary of the ignition transformer 18. The electric motor 17 is thus energized, and operates the pump to pump oil from the oil storage tank to the burner. Ignition of the oil is accomplished by the ignition transformer 18. Limit control switch contacts 12 serve as a safety feature, shutting down the entire system when, for example, an excessive temperature is sensed.

It will be recognized by those skilled in the art that the basic control circuit illustrated in FIG. 1 and discussed above is only one of many possible configurations to which Applicant's invention can be applied. However, the following discussion describing the invention as applied to this basic control circuit sufficiently illustrates the invention so as to permit its use with different and more complicated systems.

Figure 2:
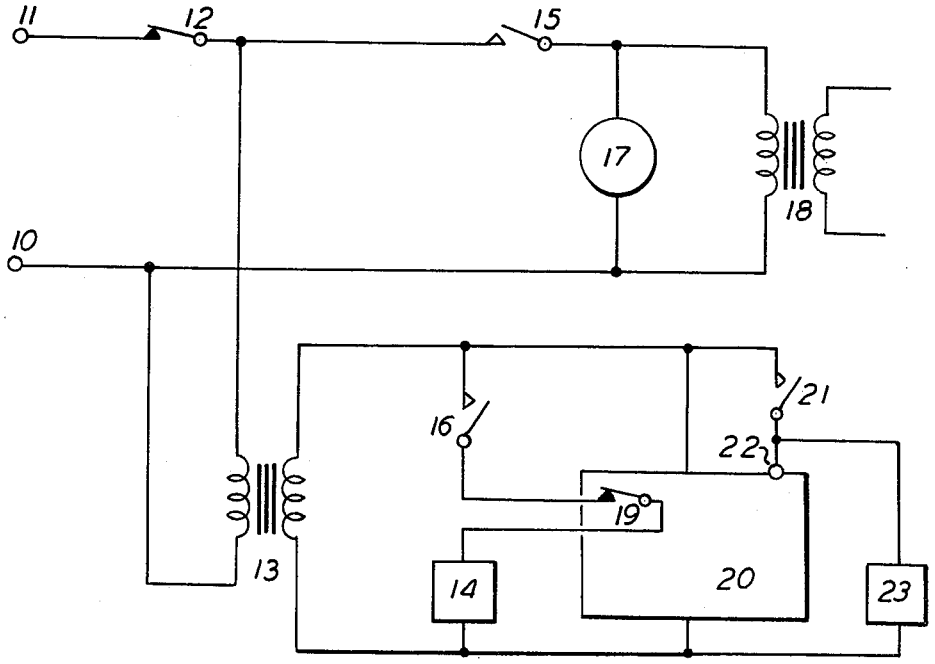
FIG. 2 shows an embodiment of the invention adapted for incorporation into the illustrative basic control circuit of FIG. 1.

Referring now to FIG. 2, which illustrates Applicant's invention as incorporated into the basic control circuit of FIG. 1, it will be noted that line voltage electric power is again applied to a pair of terminals: the common terminal 10 and the hot terminal 11. The limit control switch contacts 12 are connected in series between the hot terminal 11 and the remaining circuitry. Control transformer 13, having its primary winding connected between the common terminal 10 and the hot terminal 11 through limit control switch contacts 12, serves to step down the line-voltage electric power to a lower control voltage suitable for operating the various controls.

A control relay, having a control relay coil 14 and control relay contacts 15, is provided to control operation of the electric motor 17, which serves to operate the oil pump, and the ignition transformer 18. Line-voltage electric power is applied to electric motor 17 and ignition transformer 18 through control relay contacts 15. Thermostat contacts 16 are connected, as in FIG. 1, in series with the control relay coil 14; however, timer contacts 19 are also connected in series with the control relay coil 14. Timer contacts 19, when open, therefore prevent control relay coil 14 from being energized and thereby prevent control relay contacts 15 from closing to supply power to the electric motor 17 and the ignition transformer 18. Of course, when timer contacts 19 are closed, the system operates as in FIG. 1: When thermostat contacts 16 close, control relay coil 14 is energized, causing control relay contacts 15 to close; the electric motor 17 operates, causing oil to be pumped from the oil storage tank to the burner where it is ignited by the ignition transformer 18.

Timer means 20, which includes timer contacts 19 and timing interval initiating terminal 22, operates in response to the operation of fill acknowledgement switch 21, which is connected to timing interval initiating terminal 22. When fill acknowledgement switch 21 is operated, even momentarily, timer means 20 causes timer contacts 19 to open for a predetermined time interval sufficient to allow sediment, stirred up by filling the oil storage tank, to settle once again to the bottom of the oil storage tank. During this predetermined time interval, while sediment may still remain in suspension in the oil within the oil storage tank, the oil pump is prevented from operating. After the predetermined time interval has elapsed, and the sediment has once again settled to the bottom of the oil storage tank, timer contacts 19 close and the system resumes normal operation.

In a broad sense, timer means 20, including timer contacts 19 and timing interval initiating terminal 22, can be considered "protection means," since it serves to protect the system by preventing the oil pump from operating when there is a possibility that such operation might draw suspended sediment from the oil storage tank and cause system malfunction.

In its simplest form, fill acknowledgement switch 21 may be a pushbutton or toggle switch located adjacent to the oil storage tank. The individual filling the tank must be instructed to operate the switch prior to transferring oil into the tank. Alternatively, to prevent unauthorized operation of the fill acknowledgement switch 21 and resultant unnecessary disabling of the oil burner installation, fill acknowledgement switch 21 can by a key-operated switch. In the case, keys would be given only to those individuals responsible for refilling the oil storage tank.

In a more sophisticated system, fill acknowledgement switch 21 may be mechanically interlocked with the fill cap of the oil storage tank so that opening the fill cap serves to operate fill acknowledgement switch 21, thereby initiating the predetermined time interval during which the oil pump is temporarily disabled. In this arrangement, the fill cap of the oil storage tank may be a locking-type cap to prevent unauthorized opening of the cap with resultant unnecessary disabling of the oil burner installation.

Fill acknowledgement switch 21 can be considered, in a broad sense, "detection means," because it serves to detect that the oil storage tank is about to be filled immediately prior to commencement of the filling operation.

It may be desirable, in certain applications, to provide an indication of the operation of fill acknowledgement switch 21. This feature is most valuable in those embodiments of the invention that call for a voluntary act, such as actuation of a key-operated switch, on the part of the individual filling the tank. Should the individual neglect to operate the fill acknowledgement switch 21, the protection afforded by Applicant's invention is not operative; therefore, it is desirable that some positive indication be provided that the fill acknowledgement switch was in fact operated. Additionally, in other embodiments of Applicant's invention which do not require a voluntary act on the part of the individual filling the tank, it may be desirable to count, and provide a count of, the number of times the fill acknowledgement switch has been operated simply as a check on the number of times the oil storage tank has been filled.

For such applications, a counter 23 may be included to provide a check on operation of the fill acknowledgement switch 21. In FIG. 2, counter 23 is shown connected to the timing interval initiating terminal 22 of the timer means 20, so that operation of fill acknowledgement switch 21 serves to increment counter 23, which counts, and presents a count of, each operation of fill acknowledgement switch 21.

Counter means 23 may typically be an electromechanical counter, although other types, including electronic counters, could also be used. The circuit arrangement must be such that operation of fill acknowledgement switch 21 causes counter 23 to increment, and circuit arrangements differing from FIG. 2, but which accomplish this same result, are also possible.

What is claimed is:

1. An improved oil burning furnace system comprising:

a. oil storage tank means for receiving and storing oil;

b. oil pump means for pumping oil from the oil storage tank means;

c. detection means, for detecting that the oil storage tank means is about to be filled with oil; and d. protection means, connected to the detection means and responsive to detection that the oil storage tank means is about to be filled with oil, for preventing operation of the oil pump means for a predetermined time interval commencing with detection that the oil storage tank means is about to be filled with oil and being of sufficient duration to allow sediment, stirred up by filling the oil storage tank means with oil, to settle.

2. An improved oil burning furnace system as recited in claim 1, further comprising:

a. counting means, connected to the detection means and responsive to detection that the oil storage tank means is about to be filled with oil, for counting, and presenting a count of, the number of times it has been detected that the oil storage tank means was about to be filled with oil, thereby indicating each such detection.

3. An improved oil burning furnace system comprising:

a. oil storage tank means for receiving and storing oil;
b. oil pump means for pumping oil from the oil storage tank means;
c. electric motor means, for operating the oil pump means;
d. control means, having control switching means through which electrical power is applied to the electric motor means, for controlling application of electric power to the electric motor means;
e. the control means having control actuating means;
f. timer means, having timer switching means connected in series with the control actuating means, for preventing the control actuating means from being energized for a predetermined time interval of sufficient duration to allow sediment, stirred up by filling the oil storage tank means with oil, to settle;
g. fill acknowledgement means, having fill acknowledgement switching means, for being operating to signify that the oil storage tank means is about to be filled with oil;
h. the timer means having timing interval initiating means, connected to the fill acknowledgement switching means and responsive to operation of the fill acknowledgement means, for initiating the predetermined time interval; and
i. whereby the oil pump means is prevented from operating for the predetermined time interval commencing with the operation of the fill acknowledgement switch means, thus allowing sediment, stirred up by filling the oil storage tank means with oil, to settle.

4. An improved oil burning furnace system as recited in claim 3, further comprising:
a. counter means, connected to the fill acknowledgement switching means and responsive to operation of the fill acknowledgement means, for counting, and presenting a count of, the number of times the fill acknowledgement means has been operated, thereby indicating each such operation of the fill acknowledgement means.

5. An improved oil burning furnace system comprising:
a. oil storage tank means for receiving and storing oil;
b. oil pump means for pumping oil from the oil storage tank means;
c. electric motor means, for operating the oil pump means;
d. timer means, having timer switching means connected in series with the electric motor means, for preventing application of electric power to the electric motor means for a predetermined time interval of sufficient duration to allow sediment, stirred up by filling the oil storage tank means with oil, to settle;
e. fill acknowledgement means, having fill acknowledgement switching means, for being operated to signify that the oil storage tank means is about to be filled with oil; and
f. the timer means having timing interval initiating means, connected to the fill acknowledgement switching means and responsive to operation of the fill acknowledgement means, for initiating the predetermined time interval;
whereby the oil pump means is prevented from operating for the predetermined time interval commencing with operation of the fill acknowledgement switch means, thus allowing sediment, stirred up by filling the oil storage tank means with oil, to settle.

6. An improved oil burning furnace system as recited in claim 5, further comprising:
a. counter means, connected to the fill acknowledgement switching means and responsive to operation of the fill acknowledgement means, for counting, and presenting a count of, the number of times the fill acknowledgement means has been operated, thereby indicating each such operation of the fill acknowledgement means.

* * * * *

UNITED STATES PATENT OFFICE

CERTIFICATE OF CORRECTION

Patent No. 3,976,421 Dated August 24, 1976

Inventor(s) EUGENE T. LEE and LEONARD J. BOX

It is certified that error appears in the above-identified patent and that said Letters Patent are hereby corrected as shown below:

Column 1, Line 49 after "provide" and before "appa" insert --an--

Column 2, Line 24 after "and a" insert --common terminal--

Column 2, Line 25 after "connected" insert --in series--

Column 3, Line 57 after "can" delete "by" insert --be--

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*